United States Patent [19]

Rudd, deceased

[11] Patent Number: 5,048,466

[45] Date of Patent: Sep. 17, 1991

[54] SUPERCRITICAL PRESSURE BOILER WITH SEPARATOR AND RECIRCULATING PUMP FOR CYCLING SERVICE

[75] Inventor: Alexander H. Rudd, deceased, late of Akron, Ohio, by Phyllis G. Rudd, executrix

[73] Assignee: The Babcock & Wilcox Company, New Orleans, La.

[21] Appl. No.: 613,414

[22] Filed: Nov. 15, 1990

[51] Int. Cl.[5] ..... F22D 7/00

[52] U.S. Cl. ..... 122/406.5; 60/646; 122/406.4; 122/479.7; 122/448.4

[58] Field of Search ..... 122/406.4, 406.5, 448.4, 122/479.7; 60/646

[56] References Cited

U.S. PATENT DOCUMENTS

| | | | |
|---|---|---|---|
| 3,194,217 | 7/1965 | Grabowski | 122/406.5 X |
| 3,194,218 | 7/1965 | Schroedter et al. | 122/406.5 |
| 3,370,573 | 2/1968 | Hanzalek et al. | 122/406.5 |
| 3,529,580 | 9/1970 | Stevens | 122/406.5 |
| 4,487,166 | 12/1984 | Haller et al. | 122/406.4 X |

*Primary Examiner*—Edward G. Favors

*Attorney, Agent, or Firm*—Vytas R. Matas; Robert J. Edwards; Eric Marich

[57] ABSTRACT

A steam generating system particularly adapted for load cycling and two-shift on/off cycling operation in which the stored heat from fluids and metals in a main fluid flow path is utilized to eliminate thermal shocking of the equipment and consequent failures due to fatigue stresses.

11 Claims, 1 Drawing Sheet

SYMBOLS: MOTOR OPERATED STOP VALVE
MOTOR OPERATED CONTROL VALVE
CHECK VALVE
TEMPERATURE, PRESSURE SENSORS

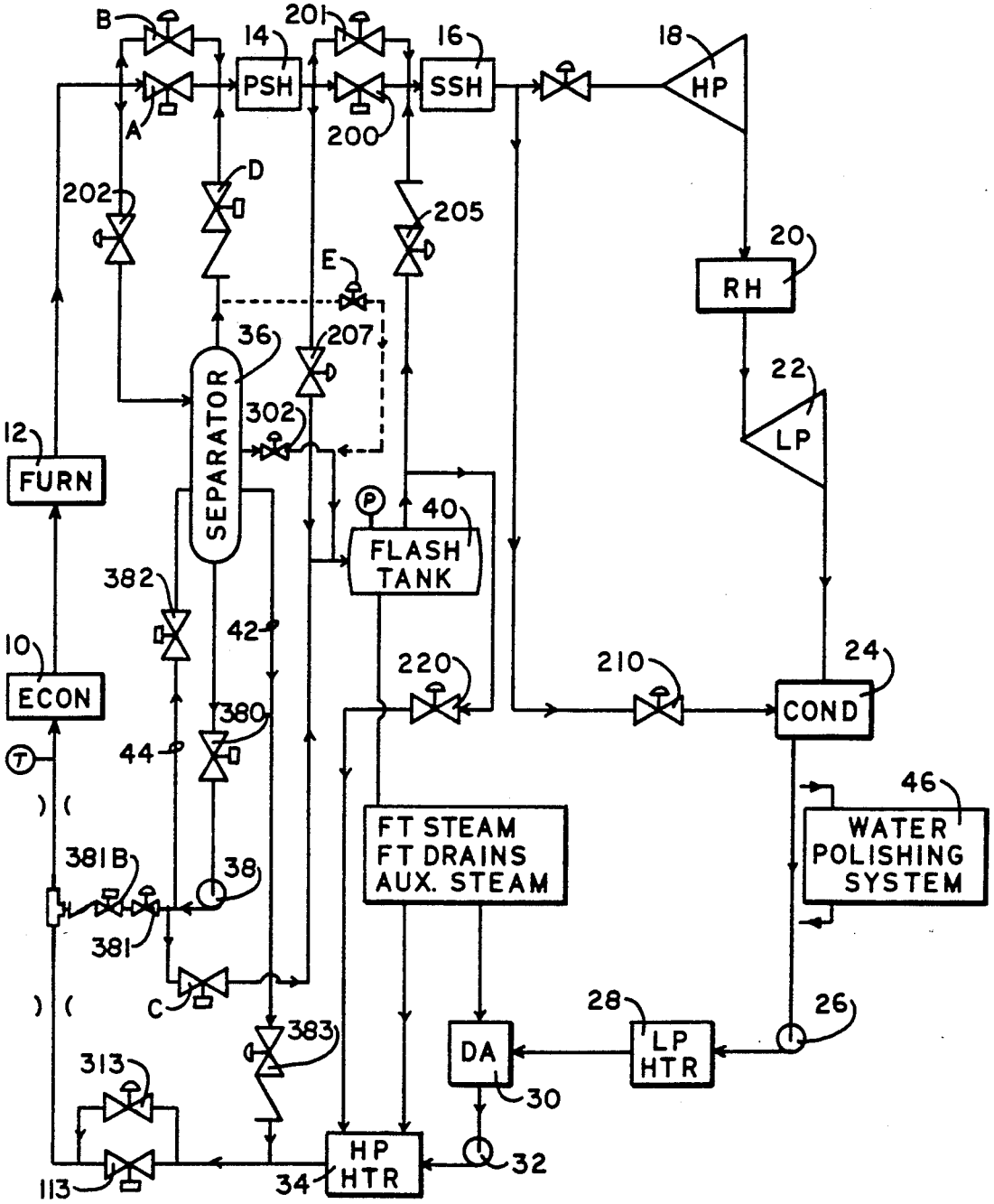
SYMBOLS: MOTOR OPERATED STOP VALVE -
MOTOR OPERATED CONTROL VALVE -
CHECK VALVE -
TEMPERATURE, PRESSURE SENSORS -
FIGURE

SUPERCRITICAL PRESSURE BOILER WITH SEPARATOR AND RECIRCULATING PUMP FOR CYCLING SERVICE

BACKGROUND OF THE INVENTION

1. Field of the Invention

The present invention relates to the design of a supercritical pressure once-through boiler system for load cycling and two-shift on/off cycling.

A trend has developed in the electric power industry toward cycling operation of large fossil-fired boiler units, in contrast to the former utility practice of base loading these larger, more efficient units. This trend has led to design problems involving thermal stresses and their corresponding effects on fatigue life. When a supercritical pressure boiler unit is idle after a brief shut down, the pressure decays to subcritical levels. In such units designed and manufactured by The Babcock & Wilcox Company, furnace pressure must be restored to supercritical levels by pumping and minimum flow in the furnace circuits established before firing can be resumed. Since under these conditions only relatively cold feedwater is available from a once-through unit, its use thermally shocks pressure parts with each restart. As a result, the unit is not suitable for the on/off cycling service required by this trend.

2. Description of the Related Art

Stevens, et al (U.S. Pat. No. 3,954,087) discloses a steam power plant start-up system and method including vertical separators located in the main flow path upstream of the superheaters. During start-up, separator liquid flows in an auxiliary flow circuit to the condenser or the main flow path upstream of the economizer. Vapor from the separators flows directly into the main flow path to the superheater and turbine. The system operates at variable pressure during start-up and supercritical pressure during operation. Stevens, et al (U.S. Pat. No. 4,099,384) is similar to the system of U.S. Pat. No. 3,954,087 except for the addition of a pressure control station upstream of the separators to maintain supercritical pressure in the furnace during start-up. Gorzegno (U.S. Pat. No. 4,241,585) describes a method of operating the vapor generator disclosed in Stevens, et al (U.S. Pat. No. 4,099,384), in which full turbine throttle pressure is reached at a higher load than that disclosed in the aforementioned U.S. Pat. No. 4,099,384 Stevens, et al patent. Miszak (U.S. Pat. No. 4,430,962) discloses a steam generating plant which is similar to the U.S. Pat. No. 3,954,087 Stevens, et al patent. The system includes a vertical separator upstream of the superheaters, and operates at variable pressure at partial loads and preferably at supercritical pressure at full load.

SUMMARY OF THE INVENTION

The present invention encompasses a steam power plant as utilized in the electric power generating industry which is particularly adapted for load cycling and two-shift on/off cycling operation. Included is a main fluid flow path and first and second auxiliary flow paths interconnected therewith. The first auxiliary flow path includes a steam separator and a circulating pump to recirculate fluid from the outlet of the furnace section back into the main flow path. Stored heat from fluids and metals of this and the economizer section is utilized to eliminate thermal shock on load pickup following a limited outage. The use of a steam separator in the first auxiliary circuit provides protection against cavitation at the circulating pump. The second auxiliary circuit insures that suitable steam conditions are provided for turbine operation while on the bypass during start-up.

The various features of novelty which characterize the invention are pointed out with particularity in the claims annexed to and forming a part of this disclosure. For a better understanding of the present invention, and the operating advantages attained by its use, reference is made to the accompanying drawing and descriptive matter in which a preferred embodiment of the invention is illustrated.

BRIEF DESCRIPTION OF THE DRAWING

The sole Figure is a diagrammatic representation of the system of the invention.

DESCRIPTION OF THE PREFERRED EMBODIMENTS

Referring to the Figure, the schematic represents a supercritical pressure boiler as applied in the electric power industry. Arrows in the lines connecting the various items described below indicate the normal direction of fluid flow therein. Major items of boiler equipment serially interconnected in a main fluid flow path include an economizer (ECON) 10, a furnace (FURN) 12, a primary superheater (PSH) 14, and a secondary superheater (SSH) 16. A high pressure turbine or turbine stage (HP) 18, a reheat superheater (RH) 20 (also a part of the boiler), a low pressure turbine or turbine stage (LP) 22, a condenser (COND) 24, a hot well pump 26, a low pressure heater (LP HTR) 28, a deaerator (DA) 30, a main feed pump 32, and a high pressure heater (HP HTR) 34 discharging fluid to the economizer 10, complete the main fluid flow path. A first auxiliary flow path is connected to the main fluid flow path, downstream of the furnace 12, and includes a vertical steam separator 36. A circulating pump 38 receives the water drains from the separator 36 for discharge into the main fluid flow path upstream of the economizer 10. A second auxiliary flow path is connected to the main fluid flow path, downstream of the first auxiliary flow path connection, and includes a flash tank 40. Flash tank drains are returned to the main flow path upstream of the economizer 10.

With regard to the first auxiliary flow path, if no separator 36 is used with the circulating pump 38, the enthalpy of the fluid at the pump inlet cannot be accurately measured or controlled and may go through a cavitation range damaging the pump, particularly on a hot restart. To further explain, the only practical way to determine the enthalpy of high pressure water is by temperature measurement. At 3500 psi, the temperature of water/steam changes very little between about 800 and 1100 Btu/lb. Unfortunately, the enthalpy at which cavitation is likely to occur in a pump lies in a range of about 850 to 950 Btu/lb. In this range of enthalpy, the supercritical pressure water acts similarly to saturated liquid at subcritical pressures. Steam bubbles form and collapse around pump impellers and casing causing severe erosion. To avoid pump cavitation in a system with a circulating pump and no separator, fluid from the furnace outlet at a high enthalpy is mixed with feedwater at a low enthalpy, upstream of the circulating pump. The only way to avoid the cavitation range is thus to stay below it in temperature by mixing high quantities of feedwater or very cold feedwater with the fluid from the furnace outlet, upstream of the pump, which would result in thermal shock (by cooling) to the inlet components of the boiler. In addition, there is a tendency to over-shoot on the cold side because of delays in firing on a restart, thus further increasing the thermal shock. However, by using a separator, only saturated liquid is recirculated and its enthalpy is measurable by either temperature or pressure. The mix ratio of it with the feedwater can therefore be controlled to avoid cavitation and thermal shock. Avoidance of both phenomena is necessary in cycling service to avoid cavitation and fatigue failures.

It is understood that only the basic equipment items and features of the invention has been included in the Figure. Other items such as water treatment systems, miscellaneous valves and flow circuits, attemperators and other components not essential to an understanding of the invention have been omitted for the sake of clarity.

During an idle period when the supercritical pressure boiler is temporarily shut down, the following conditions prevail:

a) all valves are closed except valve 380 and valve D;
b) valve 202 will open intermittently to keep separator 36 at a pressure of 800 psi below boiler pressure (or no more than 100° F. difference in saturation temperature, i.e, if the furnace 12 pressure has decayed to 1000 psi, 545° F. saturation temperature, then the separator 36 will be controlled to 400 psi, 445° F. saturation temperature);
c) motor operated drain valve C will open intermittently to keep the circulating pump 38 and valve 380 line within 20° F. of separator 36 temperature;
d) deaerator 30 and high pressure heater 34 are pressurized as high as the auxiliary steam source (not shown) and the deaerator design will permit;
e) valve 302 will open to control separator 36 high level;
f) valve D will close only on high separator level and valve 207 will open only on separator over-pressure.

During a restart of the boiler, the sequence of operation is as follows:

1) The feed pump 32 is started and a portion of the flow is recirculated (not shown) from the high pressure heater 34 outlet back to the deaerator 30;
2) Valve 207 is opened and modulated to obtain a flash tank 40 pressure whose saturation temperature is within 100° F. of economizer 10 inlet temperature and valve 220 is opened to admit flash tank 40 steam to the high pressure heater 34 (The design pressure of the high pressure heater 34 is the upper limit of the flash tank 40 pressure set point.);
3) Under these existing conditions, it is likely that valve 202 will be passing almost all steam and that there will be little water available in separator 36 to recirculate, necessitating heat recovery from separator 36 steam by way of valve 207 to minimize economizer 10 thermal shock;
4) When flash tank 40 pressure reaches set point, valve 383 in discharge line 42 opens and when separator 36 level is above the low set point, valve 382 in recirculating line 44 is opened and the circulating pump 38 is started (Experience may require modification of the flash tank 40 pressure set point to prevent too rapid a pressure decay in the boiler.);
5) With the circulating pump 38 running, valve 381B is opened and valve 381 is modulated to control separator 36 water level;
6) Valve 313 is opened to increase feedwater flow to the economizer 10 and furnace 12 to the minimum value of 25% full load flow (If much saturated water is available from the separator 36, the temperature of the mixed feed to the economizer 10 will increase, and the pressure set point for the flash tank 40 can be reduced. The valve 207 opening would then decrease, slowing the pressure decay of the boiler.);
7) Continued operation of the main feed pump 32 increases the furnace 10 pressure. When it reaches an operating value of 3500 psi, valve 202 will open to limit pressure to that value. The increased flow to the separator 36 will be steam or water; the water will be recirculated by the pump. When valve 202 changes to boiler pressure control (at 3500 psi), valve 207 action is changed to control separator 36 (and primary superheater 14) pressure to 2700 psi (800 psi below furnace 12 pressure);
8) With the flow to the boiler (combined flow of valves 313 and 381) at the minimum flow of 25% and boiler pressure at 3500 psi, firing is started, limited to obtain 1000° F. furnace exit gas temperature (FEGT). (Experience with different boiler starting conditions will probably dictate how rapidly feedwater flow can be ramped up to the minimum without unacceptable cooling shock to the economizer 10 and lower portions of the furnace 12. Greater use of auxiliary steam to heat the feedwater will also reduce thermal shocking. The ramping itself should be as rapid as possible so that firing can be started as soon as possible after starting feedwater flow. Once firing has started, water clean-up may dictate reduced firing. The speed of water clean-up can be increased by biasing valve 381 to a more closed position. Valve 302 will open to control separator 36 level, directing more water to the flash tank 40, from which it can be directed to the condenser 28 and water polishing system 46 (if desired). This action will reduce the energy level in the boiler and prolong start-up, but it may still be mandatory.);
9) Once the water is cleaned up, and the valve 302 is closed, flash tank 40 will be receiving only steam (no water) via valve 207 and its separating capability is thus no longer required. At this point, its only useful function is to provide access to the high pressure heater 34 and the deaerator 30 for feedwater heating. With the boiler being fired to obtain a 1000° F. FEGT, there should be considerable amount of water available in the separator 36 for recirculation and, therefore, little need for feedwater heating by the deaerator 30;
10) With valve 381 controlling separator 36 level, the boiler is operating like a drum boiler, and the firing rate will control separator 36 (and primary superheater 14) pressure; valve 207 would open only if the boiler is being overfired, and would pass superheated steam from the primary superheater 14 outlet to the flash tank 40;
11) To prevent exceeding the design temperature limits of the flash tank 40 by overfiring, a saturated steam dump valve E in the line shown as dotted in the Figure would open to admit saturated steam from the separator 36 to the flash tank 40, modulating the superheated steam;

12) With either valve E or 207 valve in use, steam supply to high pressure turbine or turbine stage 18 is switched to valve 201 to control throttle pressure to a nominal 100 psi, the firing rate set to control separator 36 pressure to 2600 psi or 100 psi below valves 207 or E set points. As the separator 36 pressure goes below 2600 psi, these valves will close, dropping flash tank 40 pressure below throttle pressure, which will effect closing of valve 205 on check action and stopping flow of flash tank 40 steam to secondary superheater 16;

13) The boiler is now operating as a drum boiler at separator 36 pressure and steam or water attemperators (not shown) control steam temperature. Feedwater flow through valve 313 must track turbine load, or the total flow of 25% to the boiler, whichever is greater. As firing rate and turbine load are increased, the steam quality at valve 202 will increase, circulating flow will decrease, but feedwater flow through valve 313 will increase to maintain the minimum to the boiler. When the recirculating flow through the valve 381 approaches zero, the steam quality at valve 202 approaches 100%, and flow through the primary superheater 14 can be changed to straight-through flow and separator 36 and circulating pump 38 can be removed from service (This will normally occur at close to the minimum load flow (25%) but can be made to occur at a higher load by over-feeding through the 313 valve as the minimum is approached. Extraction heating of the feedwater should be cut in at the lowest turbine loads possible.);

14) Once-through operation is accomplished by opening valve B to ramp the primary superheater 14 pressure up to 3500 psi. When valve B is 90% open (at 300 psi pressure drop), valve A is opened (pulsing the first 25% of its travel). As the primary superheater 14 is pressurized, and the valve 201 will close somewhat to hold high pressure turbine throttle pressure. When valve A is open, the pressure set point of valve 207 is changed to its overpressure relief setting. When the primary superheater 14 pressure exceeds the separator 36 pressure, valve D will close on check action. As valve B opens, valve 202 will be closing to keep the pressure at the outlet of the convection pass (not shown, but located in the main flow path downstream of the furnace 12) constant. The action of these valves D and 202 could be "smoothed" by the boiler controls by characterizing their strokes for equal total flow of both. Pressurization of the primary superheater 14 will cause a minor "blip" in steam temperature to pass through the unit because the "saturation" temperature at the primary superheater 14 inlet will be changing from 685° F. to 735° F. (i.e., as pressure increases from 2700 psi to 3500 psi). The difference represents a small change in the heat storage in the primary superheater 14 metals.

15) With valve A open, boiler pressure is controlled by the pumping/firing rate and the 201/200 valves will control the throttle pressure ramp in the conventional once-through mode;

16) Valves 381, 381B and 383 are closed, pump 38 is removed from service and the separator 36 and pump 38 are kept hot (pressurized) by intermittent opening of valves 202 and C as in the temporary shut-down mode during an idle period.

Load reduction to an idle mode is essentially the reverse procedure of the preceding and in the interest of brevity will not be described in detail. Further, it will be observed that the separator 36 must have its own complement of safety valves, or it and the piping connected to it must be designed for boiler pressure. The flash tank 40 relieving capacity must also consider the valve 302 and valve E capacity.

It is evident that the system and method of the invention eliminates problems of thermal shock leading to fatigue failures in cycling and on/off operation of utility boilers. The high level of heat recovery from an idle boiler condition will minimize auxiliary steam requirements, and thermal shock on restart. The unit can be operated down to very low loads with no heat rejection to the condenser 24. Finally, the fluid conditions at the circulating pump 38 are both measurable and controllable.

While a specific embodiment of the present invention has been shown and described in detail to illustrate the application and principles of the invention, it will be understood by those skilled in the art that it is not intended that the present invention be limited thereto and that the invention may be embodied otherwise without departing from such principles. It is thus understood that while such other embodiments have been omitted for the sake of conciseness and clarity, they are properly within the scope of the following claims.

I claim:

1. A system for cycling a once-through boiler which reduces thermal shocking of the pressure parts of the boiler upon start-up of the boiler from an idle condition after a brief shutdown, comprising:

a main fluid flow path having an economizer connected in series with a furnace;

a first auxiliary flow path connected to the main fluid flow path downstream of the furnace;

a separator in the first auxiliary flow path for separating fluid taken from the main fluid flow path into steam and water during said start-up of the boiler;

means for discharging steam from the separator into the main fluid flow path;

means for discharging water from the separator to a circulating pump in the first auxiliary flow path;

means for discharging water from the circulating pump into the main fluid flow path upstream of the economizer;

a second auxiliary flow path connected to the main fluid flow path downstream of the means for discharging steam from the separator into the main fluid flow path;

a flash tank in the second auxiliary flow path for separating fluid delivered thereto into steam and water during said start-up of the boiler;

means for discharging steam from the flash tank into the main fluid flow path; and means for discharging water from the flash tank to heat recovery means in the main fluid flow path.

2. The system as defined in claim 1, wherein the main fluid flow path further comprises a superheater, a turbine, a condenser and a main feed pump for circulating fluid in the main fluid flow path.

3. A method of starting up a once-through boiler from an idle condition after a brief shutdown, which reduces thermal shocking of the boiler pressure parts, comprising:

providing a main fluid flow path having an economizer (10), a furnace (12), a primary superheater (14), and a secondary superheater (16) fluidically connected in series;

providing a first auxiliary flow path having a valve (202), a separator (36) for separating fluid into water and steam, and a circulating pump (38) for receiving the water;

providing a second auxiliary flow path having a flash tank (40);

establishing a flow of feedwater in the main fluid flow path to absorb heat from the economizer (10) and furnace (12);

directing fluid taken from the main fluid flow path at a first point located between the furnace (12) and the primary superheater (14) through the valve (202) in the first auxiliary flow path, and discharging steam from the separator (36) into the main fluid flow path at a second point located between the first point and the primary superheater (14);

directing steam taken from the main fluid flow path through a valve (207) into the flash tank (40), and discharging water and steam from the flash tank (40) into heat recovery means (30, 34) located in the main fluid flow path to heat the feedwater and reduce thermal shocking of the boiler pressure parts.

4. The method of claim 3, further including the step of using the circulating pump (38) to discharge the water received thereby into the main fluid flow path upstream of the economizer (10) to mix with and further heat the feedwater and reduce thermal shock of the boiler pressure parts.

5. The method of claim 3, further including the step of modulating the valve (207) to control the pressure in the flash tank (40) to a set point value needed to obtain a saturation temperature within 100° F. of the temperature of the feedwater at the economizer (10) inlet.

6. The method of claim 5, further including the steps of opening a control valve (381) in a discharge line connecting the separator (36) to a point in the main fluid flow line downstream of the heat recovery means (30, 34) once pressure in the flash tank (40) reaches the set point value, opening a valve (382) in a recirculating line connecting an outlet of the circulating pump (38) and the separator (36), and starting the circulating pump (38).

7. The method of claim 6, further including the step of modulating the control valve (381) to control the water level in the separator (36).

8. The method of claim 7, further including the steps of increasing feedwater flow to the economizer (10), reducing the pressure setpoint value at the flash tank (40) as the temperature of the feedwater at the economizer (10) inlet increases, and closing the valve (207) to slow the decay of pressure in the boiler.

9. The method of claim 8, further including the steps of increasing pressure in the furnace (12) to 3500 psi, opening a valve (202) located in the first auxiliary flow path to control boiler pressure and increase flow of steam and water to the separator (36), modulating valve (207) to control separator (36) and primary superheater (14) pressure to 2700 psi, establishing a minimum flow in the main fluid flow path and initiating firing in the boiler to obtain a specified furnace exit gas temperature.

10. The method of claim 9, further including the step of biasing valve (381) to a more closed position, opening a valve (302) located in a line connecting the separator (36) and the flash tank (40) to control the water level in the separator (36) by directing more water to the flash tank (40), and directing water from the flash tank (40) to a condenser (24) and a water polishing system (46) to increase the rate of water clean-up.

11. The method of claim 10, further including the steps of closing the valve (302), to allow only valve (381) to control the separator (36) level, controlling the firing rate to control the pressure in the separator (36) and primary superheater (14), and permitting valve (207) to open only if the boiler is being over fired to pass superheated steam from the primary superheater (14) outlet to the flash tank (40).

* * * * *